US006125998A

United States Patent [19]

Batista

[11] Patent Number: 6,125,998

[45] Date of Patent: Oct. 3, 2000

[54] WHISTLE CASE

[76] Inventor: Christina Batista, 77 Vandelia Ave. Apt. 5J, Brooklyn, N.Y. 11201

[21] Appl. No.: 08/992,723

[22] Filed: Dec. 17, 1997

[51] Int. Cl.[7] ..... A45C 15/00

[52] U.S. Cl. ..... 206/38; 206/37; 206/822; 53/468; 224/607

[58] Field of Search ..... 206/37, 38, 234, 206/493, 822; 53/456, 467, 468; 150/161; 224/600, 607

[56] References Cited

U.S. PATENT DOCUMENTS

| | | | |
|---|---|---|---|
| D. 262,497 | 1/1982 | Chan . | |
| 1,525,344 | 2/1925 | Viegelmann | 206/37 |
| 3,567,085 | 3/1971 | Flores . | |
| 3,589,505 | 6/1971 | Burniski | 206/37 |
| 4,325,505 | 4/1982 | Hillman . | |
| 4,573,581 | 3/1986 | Galloway et al. | 206/37 |
| 4,960,208 | 10/1990 | Tempke | 206/38 |
| 5,305,874 | 4/1994 | McLaughlin | 206/37 |
| 5,551,564 | 9/1996 | Prater et al. | 206/37 |

*Primary Examiner*—M. D. Patterson
*Assistant Examiner*—Luan K. Bui
*Attorney, Agent, or Firm*—Richard L. Miller, P.E.

[57] ABSTRACT

A whistle case that is adapted to house and keep clean and quiet a whistle that has a mouthpiece portion and a remaining portion with a slot and a loop that extends therefrom and a ball that is movably contained therein. The whistle case includes a case sized and shaped so as to be adapted to snugly yet replaceably house the whistle therein.

6 Claims, 1 Drawing Sheet

FIG. 1
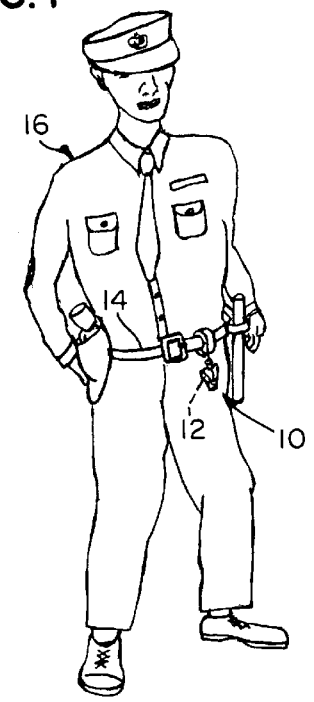
FIG. 2
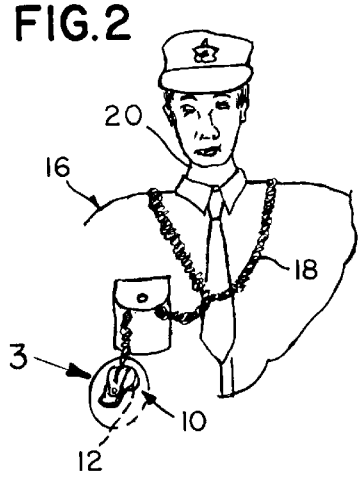
FIG. 3
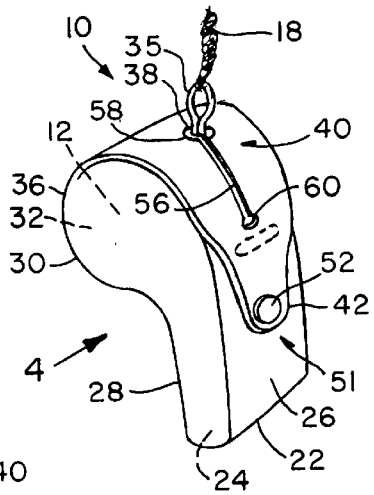
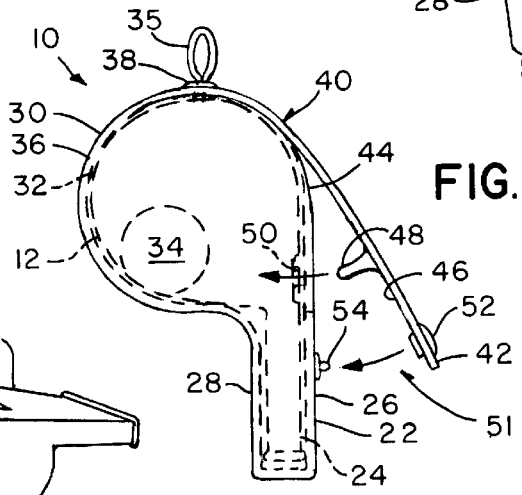
FIG. 4
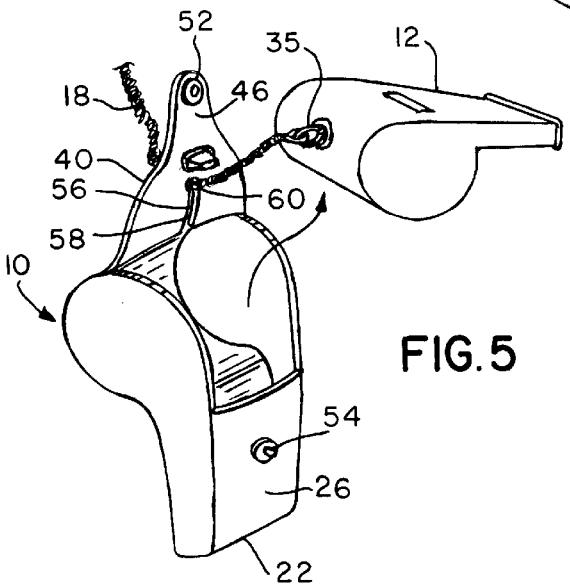
FIG. 5

WHISTLE CASE

BACKGROUND OF THE INVENTION

1. Field of the Invention

The present invention relates to a case. More particularly, the present invention relates to a whistle case.

2. Description of the Prior Art

Numerous innovations for cases have been provided in the prior art that will be described. Even though these innovations may be suitable for the specific individual purposes to which they address, however, they differ from the present invention.

FOR EXAMPLE, U.S. Pat. No. Des. 262,497 to Chan teaches the ornamental design for body supported container for small personal articles.

ANOTHER EXAMPLE, U.S. Pat. No. 3,567,085 to Flores teaches a pill container and carrier unique in that it embodies a vial having attachable and detachable upper and lower screw caps. The upper cap is provided with a flexible suspension element which encircles and is hung from the wearer's neck and is slidingly connected to the upper cap. The lower screw cap has a built-in cuplike well with a perforated cover communicating with the pill container and closing the well. The well is charged with moisture absorbing desiccative granules which function to keep the pills dry for efficacious use.

FINALLY STILL ANOTHER EXAMPLE, U.S. Pat. No. 4,325,505 to Hillman teaches a holster for a handgun that comprises a case for receiving the handgun and a flap member mounted on the case. The flap member provides a cover member for the handgun having an offset hinge associated therewith. The offset hinge comprises a pair of spaced apart arms extending from the cover member and pivotally mounted to the case to provide for swinging movement of the cover through a path clear of the case between open and closed positions. In the open position the cover member is clear of the top of the case and at an over-center position relative to the axis of pivot so as to be maintained thereat. Snap fasteners, separate from the offset hinge, secure the cover to the case in the closed position to assure a maximum degree of safety, security and protection to the holstered handgun.

It is apparent that numerous innovations for cases have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a whistle case that avoids the disadvantages of the prior art.

ANOTHER OBJECT of the present invention is to provide a whistle case that is simple and inexpensive to manufacture.

STILL ANOTHER OBJECT of the present invention is to provide a whistle case that is simple to use.

BRIEFLY STATED, YET ANOTHER OBJECT of the present invention is to provide a whistle case that is adapted to house and keep clean and quiet a whistle that has a mouthpiece portion and a remaining portion with a slot and a loop that extends therefrom and a ball that is movably contained therein. The whistle case includes a case sized and shaped so as to be adapted to snugly yet replaceably house the whistle therein.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention housing a whistle that is attached to a belt of a user;

FIG. 2 is a diagrammatic perspective view of the present invention housing a whistle that is hung by a chain from a neck of a user;

FIG. 3 is an enlarged diagrammatic perspective view of the present invention as generally enclosed by the dotted circle identified by arrow 3 in FIG. 2;

FIG. 4 is an enlarged side elevational view taken generally in the direction of arrow in FIG. 3; and FIG. 5 is a diagrammatic perspective view of the present invention shown in FIG. 3, but with the flap open and the whistle being removed.

LIST OF REFERENCE NUMERALS UTILIZED IN THE DRAWING

10 whistle case of the present invention
12 whistle
14 belt of user 16
16 user
18 chain from neck 20 of user 16
20 neck of user 16
22 distal portion
24 mouth piece portion of whistle 12
26 front wall of distal portion 22
28 back wall of distal portion 22
30 proximal portion
32 remaining portion of whistle 12
34 ball in remaining portion 32 of whistle 12
35 loop on remaining portion 32 of whistle 12
36 rear wall of proximal portion 30
38 generally uppermost position of proximal portion 30
40 flap
42 terminal point of flap 40
44 open portion in proximal portion 30
46 inner surface of flap 40
48 optional tab on inner surface 46 of flap 40
50 slot in remaining portion 32 of whistle 12
51 snap
52 male portion of snap 51
54 female portion of snap 51
56 throughslot in flap 40
58 wide throughbore of throughslot 56 in flap 40
60 narrow throughbore of throughslot 56 in flap 40

DETAILED DESCRIPTION OF THE PREFERRED EMBODIMENT

Referring now to the figures in which like numerals indicate like parts, and particularly to FIGS. 1 and 2, respectively, the whistle case of the present invention is shown generally at 10 housing and keeping clean and quiet a whistle 12 that is attached to a belt 14 of a user 16, and housing and keeping clean and quiet the whistle 12 that is hung by a chain 18 from a neck 20 of the user 16.

The configuration of the whistle case 10 can best be seen in FIGS. 3 and 4, and as such will be discussed with reference thereto.

The whistle case 10 is sized and shaped so as to snugly yet replaceably house the whistle 12 therein and thereby includes a distal portion 22 that is adapted to replaceably house a mouth piece portion 24 of the whistle 12.

The distal portion 22 is hollow and generally rectangular-parallelepiped-shaped, and has a front wall 26 and a back wall 28 that generally opposes the front wall 26 of the distal portion 22.

The whistle case 10 further includes a proximal portion 30 that is adapted to replaceably house a remaining portion 32 of the whistle 12 that has a ball 34 movable therein and a loop 35 that extends therefrom.

The proximal portion 30 is hollow and integrally formed with and extends transversely from the distal portion 22.

The proximal portion 30 is generally cylindrically-shaped and has a rear wall 36 that is generally semi-circular-shaped and extends generally rearwardly and upwardly from the back wall 28 of the distal portion 22 to a generally uppermost position 38 of the proximal portion 30, where it terminates in a flap 40.

The flap 40 extends generally downwardly and replaceably onto the front wall 26 of the distal portion 22 to a terminal point 42, and leaves an open portion 44 in the proximal portion 30 that extends from the generally uppermost position 38 of the proximal portion 30 to the front wall 26 of the distal portion 22 that is selectively opened and closed by the flap 40.

The flap 40 has an inner surface 46 that faces the front wall 26 of the distal portion 22 with an optional tab 48 that is resilient and extends inwardly therefrom and through the open portion 44 in the proximal portion 30, through a slot 50 in the remaining portion 32 of the whistle 12, and onto and retaining the ball 34 in the remaining portion 32 of the whistle 12 when the flap 40 is in a closed position so as to prevent the ball 34 in the remaining portion 32 of the whistle 12 from moving and causing noise when the whistle 12 is not in use.

The flap 40 is maintained in the closed position by a snap 51 that has a male portion 52 that extends inwardly from the inner surface 46 of the flap 40 in proximity to the terminal point 42 of the flap 40, and a female portion 54 that is disposed on the front wall 26 of the distal portion 22 and selectively interlockingly mates with the male portion 52 of the snap 51.

The flap 40 further has a throughslot 56 that extends along its longitudinal center from the uppermost position 38 of the proximal portion 30 where it widens into a wide throughbore 58 to just prior to the optional tab 48 on the inner surface 46 of the flap 40 where it widens into a narrow throughbore 60 that is smaller than the wide throughbore 58 of the throughslot 56 in the flap 40.

The operation of the whistle case 10 in conjunction with the whistle 12 that is hung by the chain 18 from the neck 20 of the user 16 can best be seen in FIGS. 3–5, and as such will be discussed with reference thereto.

STEP 1: As shown in FIG. 3, place the whistle 12 in the whistle case 10, with the mouth piece portion 24 of the whistle 12 being housed snugly in the distal portion 22, and with the remaining portion 32 of the whistle 12 being housed snugly in the remaining portion 30.

STEP 2: Pass the chain 18 upwardly through the throughslot 56 in the flap 40.

STEP 3: Begin to close the flap 40.

STEP 4: Cause the loop 35 on the remaining portion 32 of the whistle 12 to move up the throughslot 56 in the flap 40 and extend upwardly through the wide throughbore 58 at one extreme of the throughslot 56 in the flap 40.

STEP 5: As shown in FIG. 4, cause the optional tab 48 on the inner surface 46 of the flap 40 to extend through the open portion 44 in the proximal portion 30, through the slot 50 in the remaining portion 32 of the whistle 12, and onto and retain the ball 34 in the remaining portion 32 of the whistle 12 so as to prevent the ball 34 in the remaining portion 32 of the whistle 12 from moving and causing noise when the whistle 12 is not in use.

STEP 6: Maintain the flap 40 closed by interlocking the male portion 52 of the snap 51 on the inner surface 46 of the flap 40 with the female portion 54 of the snap 51 on the front wall 26 of the distal portion 22 so as to allow the whistle 12 to be snugly housed in the whistle case 12.

STEP 7: As shown in FIG. 5, open the flap 40 by unlocking the male portion 52 of the snap 51 on the inner surface 46 of the flap 40 from the female portion 54 of the snap 51 on the front wall 26 of the distal portion 22 of the whistle case 10.

STEP 8: As shown in FIG. 4, cause the optional tab 48 on the inner surface 46 of the flap 40 to leave the ball 34 in the remaining portion 32 of the whistle 12, leave the slot 50 in the remaining portion 32 of the whistle 12, and leave the open portion 44 in the proximal portion 30 so as to allow the ball 34 in the remaining portion 32 of the whistle 12 to move when the whistle 12 is in use.

STEP 9: As shown in FIG. 5, cause the loop 35 of the whistle 12 to leave the wide throughbore 58 of the throughslot 56 in the flap 40.

STEP 10: Remove the whistle 12 from the whistle case 10.

STEP 11: Cause the chain 18 to move down and through the throughslot 56 in the flap 40 a sufficient amount to allow usage of the whistle 12.

STEP 12: Interlock the chain 18 in the narrow throughbore 60 of the throughslot 56 in the flap 40 so as to prevent the chain 18 from moving relative to the whistle case 10 during use.

It will be understood that each of the elements described above, or two or more together, may also find a useful application in other types of constructions differing from the types described above.

While the invention has been illustrated and described as embodied in a whistle case, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A whistle case for housing and keeping clean and quiet a whistle that has a mouthpiece portion and a remaining portion with a slot and a loop that extends therefrom and a ball that is movably contained therein, said whistle case comprising a case sized and shaped for snugly yet replaceably housing the whistle therein; said case including a distal portion for replaceably housing the mouth piece portion of the whistle therein; said distal portion of said case beings hollow and generally rectangular-parallelepiped-shaped and having a front wall and a back wall generally opposing said front wall of said distal portion of said case; said case further including a proximal portion for replaceably housing the remaining portion of the whistle; said proximal portion of said case being generally cylindrically-shaped and having a rear wall being generally semi-circular-shaped and extending generally rearwardly and upwardly from said back wall of said distal portion of said case to a generally uppermost position of said proximal portion of said case, where it terminates in a flap; said flap extending generally downwardly and replaceably onto said front wall of said distal portion of said case to a terminal point, and leaving an open portion in said proximal portion of said case extending from said generally uppermost position of said proximal portion of said case to said front wall of said distal portion of said case being selectively opened and closed by said flap; said flap having an inner surface facing said front wall of said distal portion of said case with a tab being resilient and extending inwardly therefrom and through said open portion in said proximal portion of said case, through the slot in the remaining portion of the whistle, and onto and retaining the ball in the remaining portion of the whistle when said flap is in a closed position so as to prevent the ball in the remaining portion of the whistle from moving and causing noise when the whistle is not in use.

2. The whistle case as defined in claim 1, wherein said proximal portion of said case is hollow and integrally formed with and extends transversely from said distal portion of said case.

3. The whistle case as defined in claim 1, wherein said flap is maintained in said closed position by a snap that has a male portion that extends inwardly from said inner surface of said flap in proximity to said terminal point of said flap, and a female portion that is disposed on said front wall of said distal portion of said case and selectively interlockingly mates with said male portion of said snap.

4. The whistle case as defined in claim 3, wherein said flap further has a through slot that extends along its longitudinal center from said uppermost position of said proximal portion of said case where it widens into a wide through bore to just prior to said tab on said inner surface of said flap where it into a narrow through bore that is smaller than said wide through bore of said through slot in said flap.

5. A method of utilizing a whistle case for housing and keeping clean and quiet a whistle that has a mouthpiece portion and a remaining portion with a slot and a loop that extends therefrom with a chain thereon and a ball that is movably contained therein, said method comprising the steps of:

a) placing the whistle in said whistle case, with the mouthpiece portion of the whistle housed snugly in a distal portion of said whistle case and with the remaining portion of the whistle housed snugly in a remaining portion of said whistle case;

b) passing the chain on the loop that extends from the remaining portion of the whistle upwardly through a through slot in a flap of said whistle case;

c) beginning to close said flap so as to cause the loop on the remaining portion of the whistle to move up said through slot in said flap and extend upwardly through a wide through bore at one extreme of said through slot in said flap so as to cause a tab on an inner surface of said flap to extend through an open portion in said proximal portion, through the slot in the remaining portion of the whistle, and onto and retain the ball in the remaining portion of the whistle so as to prevent the ball in the remaining portion of the whistle from moving and causing noise when the whistle is not in use; and d) maintaining said flap closed by interlocking a male portion of a snap on said inner surface of said flap with a female portion of said snap on a front wall of said distal portion so as to allow the whistle to be snugly yet replaceably housed in said whistle case.

6. The method as defined in claim 5; further comprising the steps of:

a) opening said flap by unlocking said male portion of said snap on said inner surface of said flap from said female portion of said snap on said front wall of said distal portion so as to cause said tab on said inner surface of said flap to leave the ball in the remaining portion of the whistle, to leave the slot in the remaining portion of the whistle, and to leave said open portion in said proximal portion so as to allow the ball in the remaining portion of the whistle to move when the whistle is in use so as to cause the loop on the remaining portion of the whistle to leave said wide through bore of said through slot in said flap;

b) removing the whistle from said whistle case so as to cause the chain on the loop that extends from the remaining portion of the whistle to move down and through said through slot in said flap a sufficient amount to allow usage of the whistle; and c) interlocking the chain on the loop that extends from the remaining portion of the whistle in a narrow through bore at another extreme of said through slot in said flap so as to prevent the chain on the loop that extends from the remaining portion of the whistle from moving relative to said whistle case during use.

* * * * *